US009726432B2

(12) United States Patent
Kosuda et al.

(10) Patent No.: US 9,726,432 B2
(45) Date of Patent: Aug. 8, 2017

(54) AIR COOLING UNIT

(71) Applicant: Panasonic Corporation, Osaka (JP)

(72) Inventors: Osamu Kosuda, Osaka (JP); Osao Kido, Kyoto (JP); Atsuo Okaichi, Osaka (JP); Takumi Hikichi, Osaka (JP); Masaaki Konoto, Kyoto (JP); Noriyoshi Nishiyama, Osaka (JP); Yoshio Tomigashi, Osaka (JP); Tetsuya Matsuyama, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 145 days.

(21) Appl. No.: 14/474,186

(22) Filed: Sep. 1, 2014

(65) Prior Publication Data

US 2015/0068208 A1 Mar. 12, 2015

(30) Foreign Application Priority Data

Sep. 10, 2013 (JP) ..... 2013-187452

(51) Int. Cl.

| | |
|---|---|
| ***F28B 1/06*** | (2006.01) |
| ***F01K 11/00*** | (2006.01) |
| ***F01K 25/08*** | (2006.01) |
| ***F01K 9/00*** | (2006.01) |
| ***F01K 9/02*** | (2006.01) |

(52) U.S. Cl.

CPC ..... *F28B 1/06* (2013.01); *F01K 9/003* (2013.01); *F01K 9/02* (2013.01); *F01K 11/00* (2013.01); *F01K 25/08* (2013.01)

(58) Field of Classification Search

CPC ... F01K 27/00; F25B 7/00; F03G 6/00; B60K 16/00

See application file for complete search history.

(56) References Cited

U.S. PATENT DOCUMENTS

| | | | | |
|---|---|---|---|---|
| 3,008,297 | A | 11/1961 | Plimpton, Jr. | |
| 3,744,246 | A | 7/1973 | Doerner | |
| 6,234,400 | B1 * | 5/2001 | Guyer | F01K 17/02 237/12.1 |

(Continued)

FOREIGN PATENT DOCUMENTS

| | | |
|---|---|---|
| CN | 100408940 | 8/2008 |
| CN | 202973945 | 6/2013 |

(Continued)

OTHER PUBLICATIONS

Extended European Search Report issued Jan. 26, 2015 in corresponding European patent application No. 14182610.7.

(Continued)

*Primary Examiner* — Mark Laurenzi
*Assistant Examiner* — Shafiq Mian
(74) *Attorney, Agent, or Firm* — Wenderoth, Lind & Ponack, L.L.P.

(57) ABSTRACT

An air cooling unit is an air cooling unit used in a Rankine cycle system and includes an expander and a condenser. The expander recovers energy from a working fluid by expanding the working fluid. The condenser cools the working fluid using air. The air cooling unit includes a heat-transfer reducer that reduces heat transfer between the expander and an air path.

9 Claims, 7 Drawing Sheets

(56) References Cited

U.S. PATENT DOCUMENTS

| | | | | |
|---|---|---|---|---|
| 2005/0183421 | A1* | 8/2005 | Vaynberg | F01K 25/08 60/641.8 |
| 2007/0056287 | A1 | 3/2007 | Schoell | |
| 2010/0156111 | A1* | 6/2010 | Pesce | F01K 23/065 290/1 A |

FOREIGN PATENT DOCUMENTS

| | | |
|---|---|---|
| FR | 877 258 | 12/1942 |
| JP | 2009-221961 | 10/2009 |
| JP | 2013-007370 | 1/2013 |

OTHER PUBLICATIONS

English Translation of Chinese Search Report issued Feb. 28, 2017 in Chinese Patent Application No. 201410451874.9.

* cited by examiner

AIR COOLING UNIT

BACKGROUND

1. Technical Field

The disclosure relates to an air cooling unit included in a Rankine cycle system.

2. Description of the Related Art

As well known by persons having ordinary skill in the art, a Rankine cycle is an idealized cycle of a steam turbine. The Rankine cycle has been studied and developed from old times. In the meantime, as described in Japanese Unexamined Patent Application Publication No. 2013-7370, a waste-heat recovery generator that recovers waste-heat energy discharged from facilities such as factories or incinerators for use in power generation has been studied and developed.

In the waste-heat recovery generator according to Japanese Unexamined Patent Application Publication No. 2013-7370, a heat energy is recovered from a waste heat medium by an evaporator and the recovered heat energy is used to evaporate the working fluid in the Rankine cycle. The evaporated working fluid drives a turbine generator. After the working fluid has driven the turbine generator, the working fluid is cooled and condensed by a water-cooled condenser. The condensed working fluid is fed to the evaporator again by a pump. In this manner, electrical energy is continuously generated from the waste-heat energy. In recent years, attention has been paid to not only large-scale waste-heat recovery generators but also waste-heat recovery generators installable in relatively small facilities.

Japanese Unexamined Patent Application Publication No. 2009-221961 discloses a binary cycle power generating system illustrated in FIG. 9. A heat source fluid 1 is fed to an evaporator 2 and the evaporator 2 heats a working fluid 10 to evaporate the fluid 10. The evaporated working fluid 10 is fed to a steam turbine 4 to drive the steam turbine 4, so that power is generated. The working fluid 10 ejected from the steam turbine 4 is then fed to a condenser 6 through a heat recovery unit 8. The working fluid 10 is cooled by air and condensed into a liquid by the condenser 6. The condensed working fluid 10 is fed again to the evaporator 2 by a pump 7B and heated by the heat source fluid 1. This binary cycle power generating system can recover heat from the heat source fluid 1 and condense the working fluid 10 using air.

In the case where a water-cooled condenser is used, cooling-water generating facilities, such as a cooling tower, have to be provided. In addition, water piping has to be additionally installed between the Rankine cycle system and the cooling-water generating facilities. This installation involves problems such as increases in costs and footprint. An air-cooled condenser is considered to be advantageous to a water-cooled condenser in terms of costs and footprint. The performance of the air-cooled condenser, however, is usually inferior to the performance of the water-cooled condenser. Thus, further improvement in the performance of the air-cooled condenser is expected.

SUMMARY

In view of the above-described circumstances, one non-limiting and exemplary embodiment provides a technology for cooling a working fluid in a Rankine cycle using air more efficiently than an existing technology.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

According to an aspect of the disclosure, an air cooling unit for use in a Rankine cycle system includes an expander that expands a working fluid so as to recover energy therefrom; a condenser that is disposed on an air path of cooling air and that cools the working fluid using air flowing through the air path; and a heat-transfer reducer that reduces heat transfer between the expander and the air path.

The disclosure enables cooling a working fluid in a Rankine cycle using air more efficiently than the existing technology.

DESCRIPTION OF THE PREFERRED EMBODIMENTS

Figure 1:
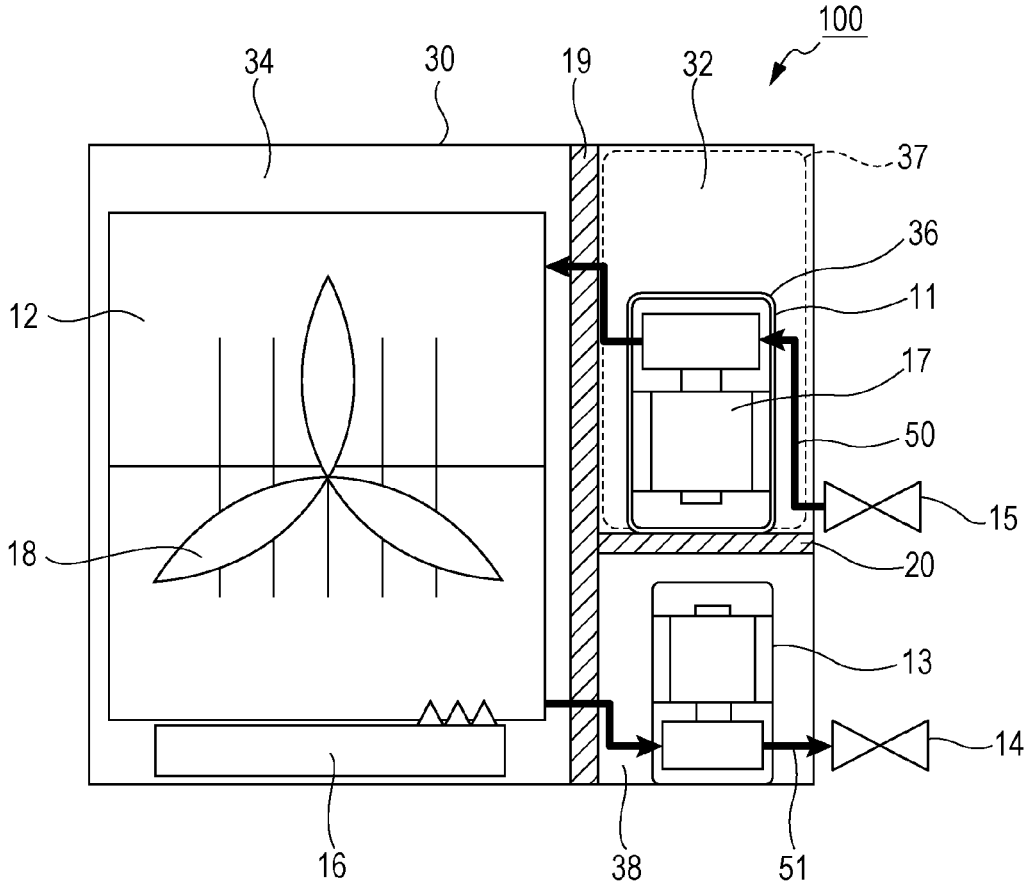
FIG. 1 illustrates a configuration of an air cooling unit according to a first embodiment when viewed from the side.

One of the advantages of an air-cooled condenser is that the condenser dispenses with equipment such as water piping. On the other hand, as the size of the Rankine cycle system is further reduced for reduction of the footprint, heat transfer between a high-temperature expander and an air path leading to a condenser becomes more problematic. When heat transfer occurs between the expander and the air path, heat is transferred from the expander to the condenser. From the expander perspective, heat of the expander is lost. From the condenser perspective, the condenser is heated. Either of the heat loss of the expander and heating of the condenser lowers the performance of the Rankine cycle system and prevents provision of a high performance Rankine cycle system.

A conceivable example of a method for reducing the heat transfer is to keep a sufficient distance between the expander and the condenser. Such positioning, however, involves disadvantages such as an increase in footprint of the Rankine cycle system or an increase in length of pipes between the expander and the condenser. Consequently, the advantage of the air-cooled condenser, that is, the advantage of the footprint-saving feature is impaired. In order to provide a high-performance Rankine cycle system including an air-cooled condenser while maintaining an advantage of a footprint-saving feature, a technology for reducing heat transfer between an expander and an air path leading to a condenser is beneficial.

A first aspect of the disclosure is an air cooling unit for use in a Rankine cycle system that includes an expander that expands a working fluid so as to recover energy therefrom; a condenser that is disposed on an air path of cooling air and that cools the working fluid using air flowing through the air path; and a heat-transfer reducer that reduces heat transfer between the expander and the air path.

In this configuration, the heat-transfer reducer can reduce heat transfer between the expander and the air path leading to the condenser.

Here, examples of the heat-transfer reducer include a partition disposed between the expander and the air path and a heat insulator that surrounds the expander. The heat-transfer reducer may have any form as long as it reduces heat transfer between the expander and the air path.

In addition to the first aspect, a second aspect of the disclosure provides an air cooling unit wherein the heat-transfer reducer includes a partition disposed between the expander and the air path. In this configuration, the partition can reduce heat transfer between the expander and the air path leading to the condenser.

In addition to the second aspect, a third aspect of the disclosure provides an air cooling unit that further includes a housing that houses the expander and the condenser, wherein the housing includes an expander storage for storing the expander and a condenser storage for storing the condenser, the expander storage and the condenser storage being partitioned by the partition.

In this configuration, the partition can reduce heat transfer between the expander and the air path leading to the condenser.

In addition to any one of the first to third aspects, a fourth aspect of the disclosure provides an air cooling unit that further includes a pump that receives the working fluid ejected from the condenser and ejects the working fluid to circulate the working fluid in the Rankin cycle system. This configuration dispenses with separately providing a pump outside the air cooling unit.

In addition to the fourth aspect, a fifth aspect of the disclosure provides an air cooling unit wherein the expander is positioned above the pump. Such a positional relationship enables reduction of heat transfer from the expander to the pump on the basis of the characteristic that warm air rises.

In addition to the first aspect, a sixth aspect of the disclosure provides an air cooling unit that further includes a pump that receives the working fluid ejected from the condenser and ejects the working fluid to circulate the working fluid in the Rankin cycle system; and a housing that houses the expander, the condenser, and the pump, wherein the heat-transfer reducer includes a partition that is disposed inside the housing and that partitions an internal space of the housing into at least an expander storage in which the expander is disposed, a condenser storage in which the condenser is disposed, and a pump storage in which the pump is disposed. The partition reduces heat transfer between the expander, the pump, and the condenser.

In addition to the sixth aspect, a seventh aspect of the disclosure provides an air cooling unit wherein the expander storage is positioned above the pump storage. Such as positional relationship enables reduction of heat transfer from the expander storage to the pump storage on the basis of the characteristic that warm air rises.

In addition to the sixth or seventh aspect, an eighth aspect of the disclosure provides an air cooling unit that further includes a controller that is disposed in the pump storage and that controls the air cooling unit or the Rankine cycle system. When the controller is disposed in the pump storage, the temperature of the controller can be prevented from rising to an excessive level.

In addition to any one of the sixth to eighth aspects, a ninth aspect of the disclosure provides an air cooling unit that further includes a reheater that is disposed in the expander storage and that causes the working fluid ejected from the pump and the working fluid ejected from the expander to exchange heat therebetween. When the reheater is disposed in the expander storage, heat can be recovered from the expander storage directly by the reheater or through a pipe connected to the reheater.

In addition to any one of the sixth to ninth aspects, a tenth aspect of the disclosure provides an air cooling unit, wherein a first flow path for connecting the expander to an evaporator disposed outside the air cooling unit extends to an outside of the housing through the expander storage, wherein a second flow path for connecting the pump to the evaporator disposed outside the air cooling unit extends to the outside of the housing through the expander storage, and wherein a first connector for connecting a pipe connected to an outlet of the evaporator to the first flow path and a second connector for connecting a pipe connected to an inlet of the evaporator to the second flow path are disposed outside the housing. In this configuration, heat transfer to the air path leading to a condenser and the pump can be reduced.

In addition to any one of the third and sixth to tenth aspects, an 11th aspect of the disclosure provides an air cooling unit that further includes a first heat insulator that surrounds the expander storage. When the expander storage is surrounded by the first heat insulator, a high-temperature pipe connected to the expander can be thermally insulated at the same time.

In addition to any one of the third and sixth to ninth aspects, a 12th aspect of the disclosure provides an air cooling unit that further includes an evaporator that is disposed in the expander storage and that evaporates the working fluid. When the evaporator is disposed in the expander storage, heat transfer between the evaporator and the air path leading to a condenser can be reduced and heat transfer between the evaporator and the pump can be also reduced.

In addition to any one of the sixth to tenth aspects, a 13th aspect of the disclosure provides an air cooling unit that further includes a bypass passage through which the working fluid flows while bypassing the expander; and a control valve that is disposed on the bypass passage and that adjusts a flow rate of the working fluid flowing through the bypass passage, wherein the control valve is disposed in the pump storage. When the control valve is disposed in a low-temperature pump storage, the control valve can be prevented from being damaged due to heat.

In addition to any one of the third and sixth to 12th aspects, a 14th aspect of the disclosure provides an air cooling unit that further includes a bypass passage through which the working fluid flows while bypassing the expander; and a control valve that is disposed on the bypass passage and that adjusts a flow rate of the working fluid flowing through the bypass passage, wherein the control valve is disposed in the expander storage. When the control valve is disposed in the expander storage, heat transfer from a high-temperature working fluid at an upstream portion of the bypass passage to low-temperature members such as the condenser and the pump can be reduced.

In addition to any one of the third and sixth to 12th aspects, a 15th aspect of the disclosure provides an air cooling unit that further includes a bypass passage through which the working fluid flows while bypassing the expander; and a control valve that is disposed on the bypass passage and that adjusts a flow rate of the working fluid flowing through the bypass passage, wherein the control valve is disposed in the condenser storage. When the control valve is disposed in a low-temperature condenser storage, the control valve can be prevented from being damaged due to heat.

In addition to any one of the fourth to tenth and 13th aspects, a 16th aspect of the disclosure provides an air cooling unit wherein the pump is positioned upwind from the condenser. Such a positional relationship enables cooling the pump with air that is to be supplied to the condenser.

In addition to any one of the fourth to seventh aspects, a 17th aspect of the disclosure provides an air cooling unit that further includes a controller that controls the air cooling unit or the Rankine cycle system, wherein the controller is cooled with the working fluid ejected from the pump. The working fluid at the outlet of the pump is, for example, in a liquid phase state and has a temperature in the range of, for example, 20 to 50° C. Such a working fluid is usable for cooling the controller.

In addition to any one of the fourth to eighth and 17th aspects, an 18th aspect of the disclosure provides an air cooling unit that further includes a reheater that causes the working fluid ejected from the pump and the working fluid ejected from the expander to exchange heat therebetween. In the reheater, the heat energy of the working fluid ejected from the expander can be transferred to the working fluid ejected from the pump.

In addition to the fourth or fifth aspect, a 19th aspect of the disclosure provides an air cooling unit that further includes a housing that houses the expander, the condenser, and the pump, wherein a first flow path for connecting the expander to an evaporator disposed outside the air cooling unit and a second flow path for connecting the pump to the evaporator disposed outside the air cooling unit extend to an outside of the housing, and wherein a first connector for connecting a pipe connected to an outlet of the evaporator to the first flow path and a second connector for connecting a pipe connected to an inlet of the evaporator to the second flow path are disposed opposite a space in which the condenser is disposed with a space in which the expander or the pump is disposed interposed therebetween. This configuration enables reduction of heat transfer between the connector and the air path leading to a condenser.

In addition to any one of the first to 19th aspects, a 20th aspect of the disclosure provides an air cooling unit wherein the condenser includes a fin-tube-type heat exchanger. The fin-tube-type heat exchanger contributes to cost saving and footprint reduction of the air cooling unit.

In addition to the 20th aspect, a 21st aspect of the disclosure provides an air cooling unit, wherein the fin-tube-type heat exchanger includes an upstream portion disposed on an upstream side in an air-flow direction and a downstream portion disposed on a downstream side in the air-flow direction, and wherein a gap is formed between the upstream portion and the downstream portion. In this configuration, heat is unlikely to transfer in the air flow direction. Thus, the cooled working fluid can be prevented from being reheated.

In addition to any one of the first to 19th aspects, a 22nd aspect of the disclosure provides an air cooling unit, wherein the condenser includes an upstream portion disposed on an upstream side in an air-flow direction and a downstream portion disposed on a downstream side in the air-flow direction. In this configuration, pipes of the condenser can be arranged, the inner diameter of each pipe can be changed, or the specifications of the fins can be determined so that the working fluid and air exchange heat therebetween in a counter flow arrangement.

In addition to the 22nd aspect, a 23rd aspect of the disclosure provides an air cooling unit, wherein the upstream portion is a portion of the condenser positioned most upstream in the air-flow direction, and wherein an outlet of the condenser is disposed in the upstream portion. In this configuration, air and the working fluid exchange heat therebetween in a counter flow arrangement. Thus, the heat exchange can be highly efficiently performed.

In addition to the 22nd or 23rd aspect, a 24th aspect of the disclosure provides an air cooling unit, wherein the downstream portion is a portion of the condenser positioned most downstream in the air-flow direction, and wherein an inlet of the condenser is disposed in the downstream portion. In this configuration, air and the working fluid exchange heat therebetween in a counter flow arrangement. Thus, the heat exchange can be highly efficiently performed.

In addition to the second or third aspect, a 25th aspect of the disclosure provides an air cooling unit, wherein the partition is positioned so as to restrict air movement from a space in which the expander is disposed to the air path or from the air path to the space in which the expander is disposed. By restricting the air movement, heat transfer due to convection can be reduced.

In addition to the second or third aspect, a 26th aspect of the disclosure provides an air cooling unit, wherein the partition facilitates formation of air flow in the air path. In this configuration, air can be guided to the condenser while the loss at the air path is kept low.

In addition to any one of the first to 26th aspects, a 27th aspect of the disclosure provides an air cooling unit further includes a fan that is positioned upwind from the condenser and that supplies air to the condenser. Such a positional relationship enables preventing a motor that drives the fan from being heated by air that has been heated by the condenser.

In addition to any one of the first to seventh, 19th, 25th, and 26th aspects, a 28th aspect of the disclosure provides an air cooling unit that further includes a controller that is positioned upwind from the condenser and that controls the air cooling unit or the Rankine cycle system. Such a positional relationship enables cooling the controller by air that is to be supplied to the condenser.

In addition to any one of the first to ninth, 18th, 19th, 25th, 26th, and 28th aspects, a 29th aspect of the disclosure provides an air cooling unit that further includes an evaporator that evaporates the working fluid. Such a configuration dispenses with separately providing an evaporator outside the air cooling unit.

In addition to any one of the first to 29th aspects, a 30th aspect of the disclosure provides an air cooling unit, wherein the heat-transfer reducer includes a second heat insulator that surrounds the expander. The second heat insulator can reduce heat transfer between the expander and the air path leading to the condenser.

In addition to any one of the first to 30th aspects, a 31st aspect of the disclosure provides an air cooling unit that further includes a plurality of branch flow paths through each of which the working fluid ejected from the expander flows, wherein each of the plurality of branch flow paths is connected to the condenser. Such a configuration enables reduction of pressure loss, whereby the efficiency of the condenser can be improved.

In addition to the third aspect, a 32nd aspect of the disclosure provides an air cooling unit that includes a pump that receives the working fluid ejected from the condenser and ejects the working fluid to circulate the working fluid in the Rankin cycle system and is provided in the housing, wherein a first flow path for connecting the expander to an evaporator disposed outside the air cooling unit extends to an outside of the housing through the expander storage, wherein a second flow path for connecting the pump to the evaporator disposed outside the air cooling unit extends to the outside of the housing through the expander storage, and wherein a first connector for connecting a pipe connected to an outlet of the evaporator to the first flow path and a second connector for connecting a pipe connected to an inlet of the evaporator to the second flow path are disposed outside the housing. In this configuration, heat transfer to the air path leading to a condenser and the pump can be reduced.

In addition to any one of the first to 12th and the 16th to 32nd aspects, a 33rd aspect of the disclosure provides an air cooling unit that includes a bypass passage through which the working fluid flows while bypassing the expander; and a control valve that is disposed on the bypass passage and that adjusts a flow rate of the working fluid flowing through the bypass passage. In this configuration, the flow rate of the working fluid that flow into the expander is arbitrarily adjustable by controlling the flow rate of the working fluid flowing through the bypass passage with the control valve.

A 34th aspect of the disclosure provides a Rankine cycle system that includes the air cooling unit according to any one of the first to 33rd aspects. Such a configuration enables reduction of heat transfer between the expander and the air path leading to the condenser using the heat-transfer reducer, whereby the efficiency of the Rankine cycle system can be improved further than that of an existing system.

Hereinbelow, embodiments of the disclosure will be described referring to the drawings. The embodiments described below, however, do not limit the disclosure.

First Embodiment

Figure 2:
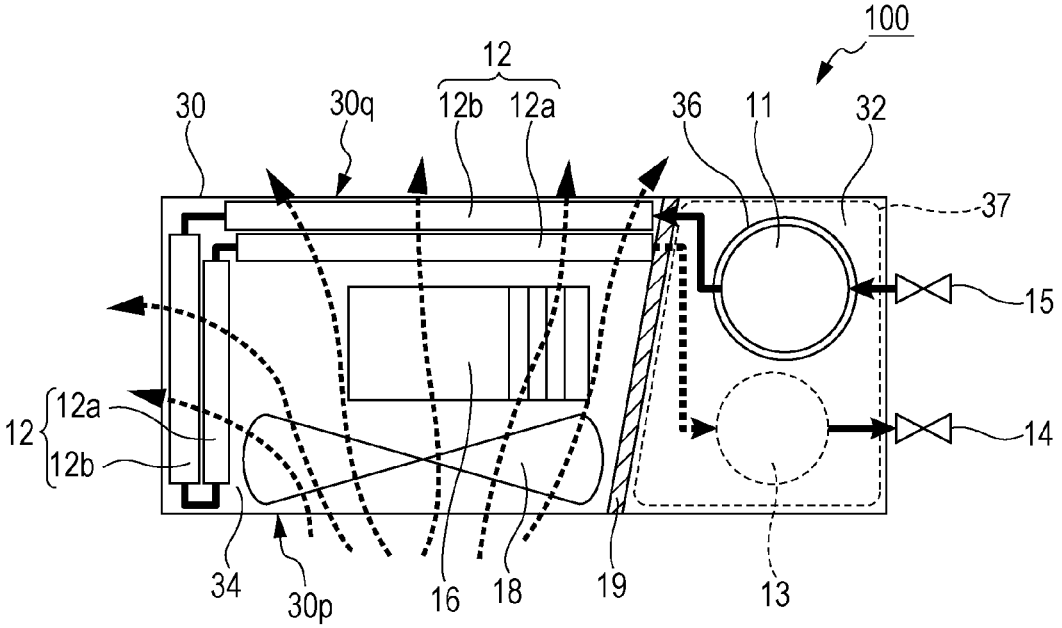
FIG. 2 illustrates the configuration of the air cooling unit according to the first embodiment when viewed from above.
Figure 3:
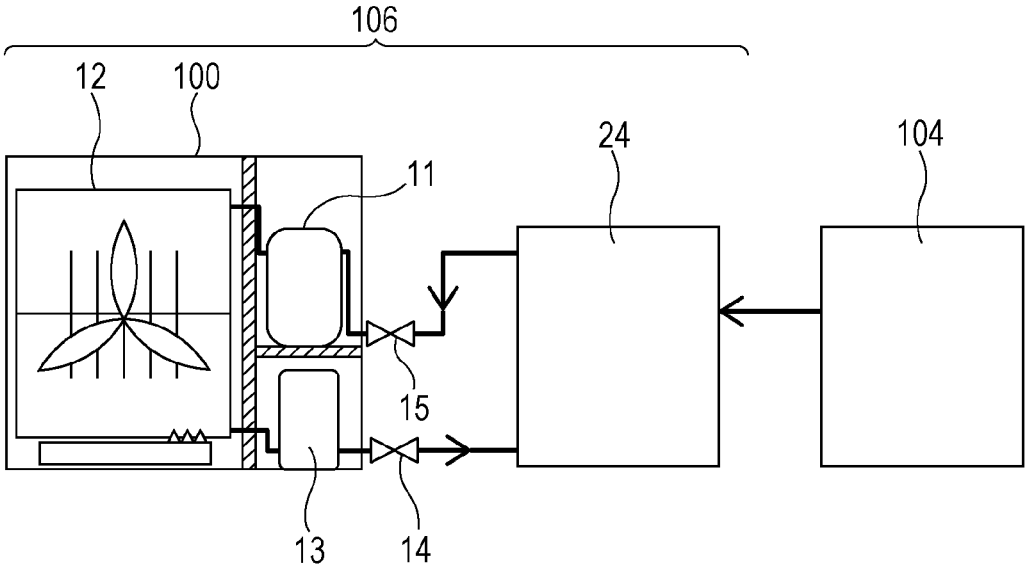
FIG. 3 illustrates a configuration of a Rankine cycle system including the air cooling unit illustrated in FIG. 1 and FIG. 2.

As illustrated in FIGS. 1 and 2, an air cooling unit 100 according to a first embodiment includes an expander 11, a condenser 12, a pump 13, a connector 14, a connector 15, a controller 16, and a housing 30. The expander 11, the condenser 12, the pump 13, and the controller 16 are housed in the housing 30. As illustrated in FIG. 3, the air cooling unit 100 is used to constitute a Rankine cycle system 106 including an evaporator 24. The Rankine cycle system 106 includes the expander 11, the condenser 12, the pump 13, and the evaporator 24. These components are annularly connected together through piping in the above-described order so as to form a closed circuit. The Rankine cycle system 106 recovers heat from a heat source 104. In other words, the heat from the heat source 104 heats a working fluid in the evaporator 24. Types of the heat source 104 are not particularly limited. One example of the heat source 104 is a waste heat path at a factory. Through the waste heat path, a heat medium (air, waste gas, steam, oil, or the like) that conveys waste heat flows.

The Rankine cycle system 106 requires the evaporator 24 that evaporates the working fluid. The configuration of the evaporator 24 is appropriately designed in accordance with the conditions such as the temperature, flow rate, and other properties of the heat medium fed from the heat source 104. Thus, the evaporator 24 may be a component independent of the air cooling unit 100. In this embodiment, the evaporator 24 is disposed outside the air cooling unit 100.

As illustrated in FIG. 3, the connector 14 and an inlet of the evaporator 24 are connected together through piping. The connector 15 and an outlet of the evaporator 24 are connected together through piping. The working fluid is transported from the air cooling unit 100 to the evaporator 24 via the connector 14. The working fluid receives heat energy at the evaporator 24 and evaporates. The working fluid in the gas state returns to the air cooling unit 100 via the connector 15.

Although the configuration according to this embodiment includes the connectors 14 and 15, the connectors 14 and 15 may be omitted. For example, the connectors 14 and 15 may be omitted in a configuration in which the evaporator 24 is installed in the housing 30.

The expander 11 expands the working fluid and converts the expansion energy of the working fluid into the turning force. A generator 17 is connected to a rotating shaft of the expander 11. The generator 17 is driven by the expander 11. The expander 11 is, for example, a displacement-type or turbo-type expander. Examples of a displacement-type expander include a scroll expander, a rotary expander, a screw expander, and a reciprocating expander. A typical example of a turbo-type expander is an expansion turbine.

The displacement type expander is recommended as the expander 11. Typical displacement type expanders operate efficiently at speeds that range over a wider range than a range of speeds at which the turbo type expanders operate efficiently. For example, the displacement type expander can keep operating efficiently at half the rated speed or lower. In other words, the power generation amount can be reduced to half the rated power generation amount or lower while the displacement type expander keeps operating efficiently. Since the displacement type expander has such a feature, the use of the displacement type expander enables an increase or reduction of the power generation amount while the expander keeps operating efficiently.

In this embodiment, the generator 17 is disposed inside the closed casing of the expander 11. Specifically, the expander 11 is a hermetic expander. The expander 11, however, may be a semi-hermetic or uncased expander.

The condenser 12 cools the working fluid ejected from the expander 11 and condenses the working fluid by causing air and the working fluid to exchange heat therebetween. A publicly-known air-cooled heat exchanger is usable as the condenser 12. An example of the air-cooled heat exchanger is a fin-tube-type heat exchanger, which contributes to cost saving and footprint reduction of the air cooling unit 100. The structure of the condenser 12 is appropriately determined in accordance with factors such as the installation location of the air cooling unit 100 or the amount of heat supplied from the heat source 104 to the Rankine cycle system 106.

The air cooling unit 100 also includes a fan 18 that feeds air to the condenser 12. The fan 18 is also disposed inside the housing 30. Air can be fed to the condenser 12 by operating the fan 18. An example of the fan 18 is a propeller fan.

The pump 13 sucks and pressurizes the working fluid that has flowed out of the condenser 12 and supplies the pressurized working fluid to the evaporator 24. An example usable as the pump 13 is a typical displacement-type or turbo-type pump. Examples of a displacement-type pump include a piston pump, a gear pump, a vane pump, and a rotary pump. Examples of a turbo-type pump include a centrifugal pump, a mixed-flow pump, and an axial-flow pump.

The evaporator 24 serves as a heat exchanger that recovers waste-heat energy ejected from facilities such as factories or incinerators. An example of the evaporator 24 is a fin-tube-type heat exchanger. The evaporator 24 can be disposed on a waste heat path (for example, an exhaust duct) at a factory, which is the heat source 104. The working fluid is heated and evaporated by the waste-heat energy at the evaporator 24.

An example usable as the working fluid in the Rankine cycle system 106 is an organic working fluid. Examples of an organic working fluid include halogenated hydrocarbon, hydrocarbon, and alcohol. Examples of halogenated hydrocarbon include R-123, R-245fa, and R-1234ze. Examples of hydrocarbon include alkane such as propane, butane, pentane, and isopentane. Examples of alcohol include ethanol. These organic working fluids may be used separately or a compound of two or more organic working fluids may be used. An inorganic working fluid such as water, carbon dioxide, or ammonia may be used as the working fluid.

The controller 16 controls members such as the pump 13, the generator 17, and the fan 18. In other words, the controller 16 controls the air cooling unit 100 or the Rankine cycle system 106. An example usable as the controller 16 is a digital signal processor (DSP) that includes an A/D conversion circuit, an input/output circuit, a processing circuit, and a memory device. A program for appropriately operating the Rankine cycle system 106 is stored in the controller 16. For an example, the controller includes a processor and a memory storing a program. The program causes the processor to operate the pump 13 and the fan 18 during power generation of the generator 17. The program may cause the processor to regulate power generation amount of the generator 17. The program may cause the processor to change the degree of opening of the control valve 23 in at least one of start-up and shutdown of the Rankine cycle system 106.

The housing 30 is a container in which components such as the expander 11, the condenser 12, and the pump 13 are housed. The housing 30 is made of, for example, metal. As illustrated in FIGS. 1 and 2, the housing 30 has, for example, a rectangular parallelepiped shape. A pair of opposing side surfaces 30*p* and 30*q* of the housing 30 respectively have openings through which air is introduced into the housing 30 and openings through which air is ejected from the housing 30.

Subsequently, the internal structure of the air cooling unit 100 is described in detail.

As illustrated in FIG. 1, the air cooling unit 100 includes a partition 19 interposed between the expander 11 and the air path leading to the condenser 12. The partition 19 reduces heat transfer between the expander 11 and the air path leading to the condenser 12. In other words, the use of the partition 19 enables reduction of heat transfer between the expander 11 and the air path leading to the condenser 12. The partition 19 is an example of the above-described heat-transfer reducer. The shape and the material of the partition 19 are not particularly limited. Examples of the partition 19 include a plate-like member. The material of the partition 19 is a publicly known material such as metal (iron, stainless steel, or aluminum), resin, or ceramics.

Here, the air path leading to the condenser 12 means a flow path inside the air cooling unit 100 (housing 30) through which cooling air flows to the condenser 12 to cool the working fluid. In other words, the condenser 12 is disposed on the cooling-air path in the air cooling unit 100. The air that flows through the air path cools the working fluid that flows through the condenser 12.

The internal space of the housing 30 is partitioned by the partition 19 into an expander storage 32 and a condenser storage 34. The expander storage 32 is a space in which the expander 11 is disposed. The condenser storage 34 is a space in which the condenser 12 is disposed.

Desirably, the partition 19 is used to completely partition the internal space of the housing 30 into the expander storage 32 and the condenser storage 34 without forming a path, such as a hole or a gap, that connects the expander storage 32 and the condenser storage 34 together. For design reasons such as an arrangement of components, however, completely separating the expander storage 32 and the condenser storage 34 from each other may be difficult. As long as the partition 19 is designed so as to minimize the heat transfer between the expander 11 and the air path leading to the condenser 12, the expander storage 32 and the condenser storage 34 do not have to be completely separated by the partition 19.

In the Rankine cycle system 106, the working fluid has the highest temperature immediately after being heated at the evaporator 24. In the air cooling unit 100, a portion through which a high-temperature working fluid flows is a flow path 50 from the connector 15 to the inlet of the expander 11. Accordingly, the temperature of the expander storage 32 is also high. In the case where the waste-heat energy discharged from facilities such as factories or incinerators is recovered for use in power generation, the temperature of the waste heat varies with factors such as the previous purposes of use of the heat before dissipated as waste heat or the conditions at the recovery of the waste heat. The temperature of the waste heat varies also with the installation conditions of the evaporator 24. The temperature of the working fluid at the inlet of the expander 11 is assumed to be increased up to, for example, 200° C.

On the other hand, in the Rankine cycle system 106, the working fluid has the lowest temperature immediately after being cooled at the condenser 12. Thus, a region having the lowest temperature is formed in the condenser storage 34. The fan 18 is disposed in the condenser storage 34. An air path through which air flows to the condenser 12 is formed in the condenser storage 34. In FIG. 2, the dashed arrows that pass through the condenser storage 34 represent typical streamlines among the streamlines representing the flow of cooling air and the directions of the air flow. In the case where the internal space of the housing 30 is partitioned with the partition 19, the condenser storage 34 substantially serves as the air path leading to the condenser 12. Air has the lowest temperature at the air path leading to the condenser 12. Although the temperature of air in the air path leading to the condenser 12 is affected by the ambient temperature surrounding the air cooling unit 100, the temperature of the air is generally equal to the ambient temperature, for example, in the range of −20 to 40° C.

As described above, the high-temperature region having a temperature of 200° C. and the low-temperature region having a temperature in the range of −20 to 40° C. coexist in the air cooling unit 100. The temperature difference between these regions is 150° C. or more. The arrangement of these regions in the air cooling unit 100 is important to improve the performance of the Rankine cycle system 106 and to reduce the size of the air cooling unit 100. If the partition 19 were removed, there would be no substance that thermally separates the high-temperature region having a temperature of 200° C. and the low-temperature region having a temperature in the range of −20 to 40° C. from each other, except for air, which is provided not for intercepting heat. Thus, both regions having a large temperature difference thermally would affect each other.

A conceivable thermal effect on the expander 11 is a heat loss from the expander 11. In the case where the heat transfer between the expander 11 and the air path leading to the condenser 12 is not reduced, such as where the expander 11 is disposed on the air path, heat is transferred from the high-temperature expander 11 to the air in the air path. Such heat transfer means that part of heat energy recovered at the evaporator 24 is dissipated into the air without being used for power generation, thereby meaning the loss of the Rankine cycle system 106. When the temperature of the working fluid supplied to the expander 11 is lowered, the efficiency of power generation decreases and the power generation amount also decreases. Thus, reducing the heat transfer between the expander 11 and the air path leading to the condenser 12 using the partition 19 is effective to efficiently supply heat energy recovered at the evaporator 24 to the expander 11 and to generate as much power as possible at the expander 11.

A conceivable thermal effect on the air path leading to the condenser 12 is an effect on conditions of the lower-side pressure on the Rankine cycle system 106. In the case where the heat transfer between the expander 11 and the air path leading to the condenser 12 is not reduced, for example, where the expander 11 is positioned upwind from the condenser 12, heat is transferred from the expander 11 to the air in the air path. Consequently, the temperature of the air in the air path rises. The rise of the temperature of the air in the air path means that the temperature of the air that cools the working fluid in the condenser 12 rises. In an air-cooled heat exchanger, the temperature difference between the working fluid and the air varies with conditions such as the air flow rate, the dimensions of the heat exchanger, or the circulation rate of the working fluid. When the heat exchanger exchanges heat at a constant heat exchange rate, the temperature difference between the working fluid and the air is substantially constant. Here, the temperature of the working fluid rises as the temperature of air is higher. Inside the condenser 12, most part of the working fluid is in a gas-liquid two-phase state. There is a correlation between the temperature of the working fluid and the pressure on the working fluid. The pressure on the working fluid is higher as the temperature of the working fluid is higher. Specifically, a rise in temperature of the air in the air path involves an increase in pressure on the working fluid in the condenser 12 (lower-side pressure in the Rankine cycle system 106).

The pressure conditions in the Rankine cycle system 106 such as the higher-side pressure or the lower-side pressure are determined due to various factors including the amount of heat received at the expander 11, the pump 13, or the evaporator 24. The higher-side pressure typically tends to increase when the lower-side pressure increases. The upper limit of the higher-side pressure is determined from the view point of pressure resistance and product safety. The higher-side pressure is typically controlled so as not exceed the upper limit. Thus, the higher-side pressure cannot exceed the upper limit even the lower-side pressure increases.

The pressure conditions at which the Rankine cycle system 106 can operate highly efficiently are uniquely determined in accordance with factors such as the designed volume ratio of the expander 11. If the higher-side pressure fails to be controlled and the lower-side pressure keeps increasing due to the heat transfer from the expander 11, the control of the pressure becomes difficult, thereby failing in a highly efficient operation of the Rankine cycle system 106. Thus, reducing the heat transfer between the expander 11 and the air path leading to the condenser 12 using the partition 19 is effective to reduce an increase of the pressure of the working fluid in the condenser 12 and to allow the Rankine cycle system 106 to have flexibility in controlling the pressure.

Instead of the partition 19 or in addition to the partition 19, the air cooling unit 100 may include a heat insulator 36 (second heat insulator) that surrounds the expander 11 in order to reduce the heat transfer between the expander 11 and the air path leading to the condenser 12. The heat insulator 36 can reduce the heat transfer between the expander 11 and the air path leading to the condenser 12. The heat insulator 36 is an example of the above-described heat-transfer reducer. Examples usable as the heat insulator 36 include a woven fabric, a non-woven fabric, a resin film, a foamed insulator, and a vacuum insulator. The heat insulator 36 may surround the expander 11 by directly touching (coming into close contact with) the expander 11. The expander 11 may be completely covered with the heat insulator 36 or may be partially covered with the heat insulator 36. The heat insulator 36 does not necessarily have to be in close contact with the expander 11. A gap may be left between the heat insulator 36 and the expander 11.

Instead of the heat insulator 36 or in addition to the heat insulator 36, the air cooling unit 100 may include a heat insulator 37 (first heat insulator) that surrounds the expander storage 32 so as to form a single space. When the expander storage 32 is surrounded with the heat insulator 37, a high-temperature pipe connected to the expander 11 can be also insulated concurrently. In this case, an insulating effectiveness is the same as the insulating effectiveness obtained when a heat insulator is directly wrapped around a high-temperature pipe. In addition, the production process of the air cooling unit 100 can be simplified. Examples usable as the heat insulator 37 include a woven fabric, a non-woven fabric, a resin film, a foamed insulator, and a vacuum insulator.

Besides the partition 19, the air cooling unit 100 may also include a partition 20 disposed between the expander 11 and the pump 13. The partition 20 is an example of the heat-transfer reducer. The shape and the material of the partition 20 are not particularly limited. The partition 20 is, for example, a plate-like member. Examples of the material of the partition 20 include publicly known materials such as metal, resin, or ceramics. The partition 19 and the partition 20 may be disposed inside the housing 30 as separate partitions. The internal space of the housing 30 is partitioned by the partition 19 and the partition 20 into the expander storage 32, the condenser storage 34, and the pump storage 38. The pump storage 38 is a space in which the pump 13 is disposed. The partition 20 reduces heat transfer between the expander storage 32 and the pump storage 38. In other words, the partition 20 reduces heat transfer between the expander 11 and the pump 13.

Examples of conceivable effects of heat transfer between the expander 11 and the pump 13 include heat loss of the expander 11 and heating of the inlet of the pump 13. The heat loss of the expander 11 means the loss of heat energy. The heating of the inlet of the pump 13 involves reduction of the efficiency of subcooling the working fluid at the inlet of the pump 13. When heated to an excessive level, the working fluid changes from the liquid phase state to the gas-liquid two-phase state at the inlet of the pump 13. Consequently, cavitation may occur at the inlet of the pump 13 or the pump 13 may operate unstably. The partition 20 is effective to avoid these inconveniences.

Similarly to the partition 19, the partition 20 is not essential. When heat is transferred from the expander 11 to the working fluid at the outlet of the pump 13, the temperature of the working fluid at the outlet of the pump 13 rises. In other words, the working fluid can recover heat energy. When the expander 11 is surrounded by the heat insulator 36, heat transfer from the expander 11 to the pump 13 is reduced. Surrounding the pump 13 (particularly, the inlet) with a heat insulator enables further reduction of heat transfer from the expander 11 to the inlet of the pump 13.

In this embodiment, the expander storage 32 is positioned above the pump storage 38 in the vertical direction. In other words, the expander 11 is positioned above the pump 13 in the vertical direction. Such positional relationship enables reduction of heat transfer from the expander storage 32 to the pump storage 38 using the characteristic that warm air rises.

The controller 16 is disposed lower than the condenser 12. Specifically, the controller 16 is disposed at a lower portion (bottom portion) of the condenser storage 34. The temperature of a space below the condenser 12 is lower than the temperature of the space above the bottom of the condenser 12. In the case where the controller 16 is disposed at such a position, the controller 16 is unlikely to receive thermal damages. This positioning is thus desirable for prolonged reliability of the Rankine cycle system 106.

The above-described positioning of the controller 16 is merely an example and is not limitative. The controller 16 may be disposed at any portion inside the housing 30 or outside the housing 30 (that is, outside the air cooling unit 100).

As illustrated in FIG. 1, the working-fluid inlet of the condenser 12 is positioned above the working-fluid outlet of the condenser 12 in the vertical direction. The condenser 12 has such a configuration that causes the working fluid to flow downward from the top. In the condenser 12, a high-temperature gas-state working fluid is cooled by air and condensed into the liquid phase state. In the above-described configuration, a low-density gas-state working fluid enters an upper portion of the condenser 12, is cooled by air, and then moves to a lower portion of the condenser 12 while being condensed into the liquid phase state having a high density. Specifically, the above-described configuration is efficient in terms of energy required to transport the working fluid and in terms of heat transfer. Desirably, the condenser 12 has a configuration in which a high-temperature low-density working fluid is held in an upper portion of the condenser 12 in the vertical direction and a low-temperature high-density working fluid is held in a lower portion of the condenser 12 in the vertical direction. In addition, desirably, the controller 16 is disposed at a lower portion of the condenser storage 34. This configuration allows the controller 16 to be situated in a lower temperature environment.

Now, the specifications of the air-cooled condenser 12 of the air cooling unit 100 are described in detail.

As known by persons having ordinary skill in the art, a fin-tube-type heat exchanger is used as an exterior unit of an air conditioning device. Air is supplied into the inside of the exterior unit using a fan and heat is exchanged between a coolant in the heat exchanger and the air. A typical fan is disposed on the downwind side of the heat exchanger in the exterior unit of an air conditioning device. If, as in the case of the exterior unit of the air conditioning device, the fan 18 were disposed on the downwind side of the condenser 12 in the air cooling unit 100 of the Rankine cycle system 106, air heated by the condenser 12 would impact the fan 18 and the fan 18 and a motor for driving the fan 18 would be heated by hot air and damaged due to heat.

As illustrated in FIG. 2, in this embodiment, the fan 18 is positioned upwind from the condenser 12. With this positional relationship, the temperature of air at the position at which the fan 18 is disposed is a temperature of air that has not yet been heated by the condenser 12. Thus, the motor for driving the fan 18 can be prevented from being heated by air that has been heated by the condenser 12. The fan 18 consequently has higher prolonged reliability.

In this embodiment, the controller 16 is positioned upwind from the condenser 12. Such positional relationship enables cooling the controller 16 with air that is to be supplied to the condenser 12. The controller 16 may be in contact with the condenser 12 so that the controller 16 is cooled by the condenser 12. Similarly, the pump 13 may be positioned upwind from the condenser 12. For example, the pump 13 may be disposed at the same position as the controller 16 illustrated in FIG. 2. Such positional relationship enables cooling the pump 13 with air that is to be supplied to the condenser 12. When the pump 13 is cooled, the working fluid at the inlet of the pump 13 can be concurrently cooled. Thus, a phenomenon can be avoided that can destabilize the Rankine cycle as a result of heating the working fluid at the inlet of the pump 13 and thus reducing the efficiency of subcooling the working fluid. In FIG. 1, the controller 16 is disposed on the downwind side of the fan 18. However, the positional relationship between the controller 16 and the fan 18 is not particularly limited. The controller 16 may be positioned upwind from the fan 18.

The condenser 12 may include upstream portions 12*a*, disposed on the upstream side in an air flow direction, and downstream portions 12*b*, disposed on the downstream side in the air flow direction. Specifically, the condenser 12 may include multiple portions 12*a* and 12*b* arranged in rows in the air flow direction. In this configuration, pipes of the condenser 12 can be arranged so that the direction of the temperature gradient of the working fluid (direction from the high-temperature upstream portions 12*b* to the low-temperature downstream portions 12*a*) and the air flow direction oppose each other. Specifically, the condenser 12 may be a counter-flow heat exchanger that causes the working fluid and air to exchange heat therebetween in a counter flow arrangement. Consequently, the efficiency of the condenser 12 can be improved. In the above-described configuration, the inner diameter of the pipes of the condenser 12 can be relatively easily changed or the specifications of the fin can be relatively easily determined. The above-described configuration can be easily employed in the case where a fin-tube-type heat exchanger is used as the condenser 12. However, the above-described configuration is also applicable to other types of heat exchangers such as the one that performs micro-channel heat exchange.

The upstream portions 12*a* may be portions of the condenser 12 positioned at the most upstream position in the air flow direction. The outlet of the condenser 12 is disposed at one upstream portion 12*a*. The downstream portions 12*b* may be portions of the condenser 12 positioned at the most downstream position in the air flow direction. The inlet of the condenser 12 is disposed at one downstream portion 12*b*. In this configuration, heat is exchanged between the air and the working fluid in a counter flow arrangement, whereby heat can be exchanged highly efficiently. In this embodiment, the pipes of the condenser 12 are arranged in two rows. However, the number of rows is not limited to two. The pipes of the condenser 12 may be arranged in three rows or more.

In FIG. 2, a gap is formed between the upstream portions 12*a* and the downstream portions 12*b*. Multiple fins constituting the upstream portions 12*a* are not connected to multiple fins constituting the downstream portions 12*b*. The multiple fins constituting the upstream portions 12*a* are components separate from multiple fins constituting the downstream portions 12*b*. This configuration is desirable because heat is unlikely to be transferred in the air flow direction and the cooled working fluid can thus be prevented from being heated again. However, the multiple fins of the upstream portions 12*a* and the multiple fins of the downstream portions 12*b* may be connected to each other.

In this embodiment, when viewed from above, the entirety of the condenser 12 has an L shape. In other words, the condenser 12 has multiple flat portions that form a predetermined angle (for example, 90 degrees). Specifically, the condenser 12 includes multiple flat upstream portions 12*a* and multiple flat downstream portions 12*b*. Air is supplied to the condenser 12 from multiple directions. Such a configuration is advantageous in terms of an increase in heat-transfer area relative to the footprint, that is, in terms of size reduction of the air cooling unit 100. In the case where the condenser 12 is constituted by multiple flat portions, the shape of the condenser 12 when viewed from above is not limited to an L shape. For example, portions of the condenser 12 may be arranged so as form a V shape when the condenser 12 is viewed from the side. Besides an L shape or V shape, portions of the condenser 12 may be arranged so as to form another shape that can increase the heat-transfer area relative to the footprint as long as the configuration is advantageous in size reduction of the air cooling unit 100.

Figure 4:
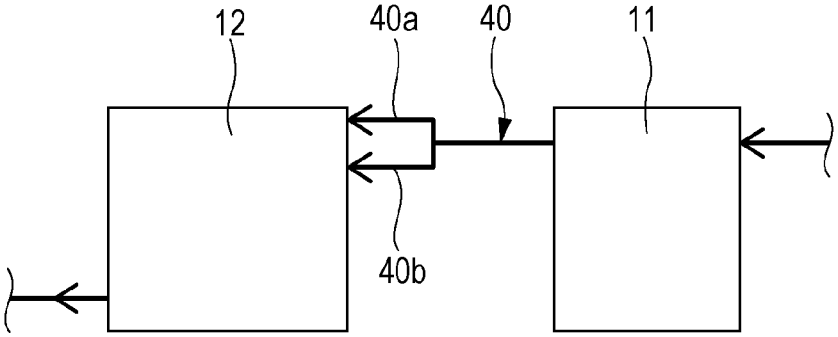
FIG. 4 illustrates a configuration of a flow path according to a modified example that connects an expander and a condenser to each other.

In this embodiment, regarding the flow path of the working fluid, the expander 11 and the condenser 12 are connected together with one flow path and the condenser 12 and the pump 13 are connected together with one flow path. However, as illustrated in FIG. 4, the air cooling unit 100 includes a flow path 40 that connects the outlet of the expander 11 and the inlet of the condenser 12. The flow path 40 may be divided into multiple branch flow paths 40*a* and 40*b* at a position between the expander 11 and the condenser 12. Each of the multiple branch flow paths 40*a* and 40*b* is connected to the condenser 12. The working fluid in the gas state is guided into the condenser 12 through the multiple branch flow paths 40*a* and 40*b*. The working fluid in the gas state has a low density and is more likely to have pressure loss. In the configuration illustrated in FIG. 4, the pressure loss can be reduced and thus the efficiency of the condenser 12 can be improved. The number of branch flow paths is not limited to two. Three or more branch flow paths may be provided, instead.

In this embodiment, the partition 19 reduces the heat transfer between the expander 11 and the air path leading to the condenser 12 by restricting the direction of air movement. In other words, the partition 19 is positioned at such a position that the partition 19 can restrict air movement from the space in which the expander 11 is disposed to the air path leading to the condenser 12. Alternatively, the partition 19 may be disposed at such a position that the partition 19 can restrict air movement from the air path leading to the condenser 12 to the space in which the expander 11 is disposed. Thus, the heat transfer between the expander 11 and the air path is reduced.

Specifically, the partition 19 restricts air flow from the condenser storage 34 to the expander storage 32 and restricts air flow from the expander storage 32 to the condenser storage 34. By restricting the air movement between the expander storage 32 and the condenser storage 34, heat transfer due to convection can be reduced. Desirably, the partition 19 has a configuration that restricts air movement between the condenser storage 34 and the expander storage 32. For example, a metal plate having no hole that allows air movement is usable as the partition 19. The conditions of the partition 20 are also the same as these conditions.

The partition 19 may have such a configuration that facilitates forming air flow in the air path leading to the condenser 12. Specifically, the partition 19 forms a wall of the air path leading to the condenser 12. Such a configuration enables guiding air to the condenser 12 while loss in the air path is reduced. In addition, heat exchange in the condenser 12 can be performed highly efficiently.

A flow path 50 (first flow path) for connecting the expander 11 to the evaporator 24 of the Rankine cycle system 106 extends to the outside of the housing 30. At the end of the flow path 50, a connector 15 (first connector) is provided. The connector 15 connects, to the flow path 50, a pipe connected to the outlet of the evaporator 24 from the outer side of the air cooling unit 100. The connector 15 is disposed opposite the space in which the condenser 12 is disposed (condenser storage 34) with the space in which the expander 11 is disposed (expander storage 32) interposed therebetween. In addition, a flow path 51 (second flow path) for connecting the pump 13 to the evaporator 24 of the Rankine cycle system 106 extends to the outside of the housing 30. At the end of the flow path 51, a connector 14 (second connector) is provided. The connector 14 connects, to the flow path 51, a pipe that is connected to the inlet of the evaporator 24 from the outside of the air cooling unit 100. The connector 14 is disposed opposite the space in which the condenser 12 is disposed (condenser storage 34) with the space in which the expander 11 is disposed (expander storage 32) interposed therebetween. As described above, the connectors 14 and 15 are disposed at positions away from the air path leading to the condenser 12, for example, outside the housing 30. The temperature of the working fluid flowing through the connector 15 reaches, for example, 200° C. Thus, if the connector 15 is disposed at a position close to the air path leading to the condenser 12, heat transfer between the connector 15 and the air path leading to the condenser 12 becomes non-negligible. In this embodiment, such heat transfer can be reduced. In the case where the connector 14 is disposed near the other connector 15 (for example, on the same surface of the housing 30), pipes can be easily connected to the connectors 14 and 15 from the outside of the air cooling unit 100. Naturally, the connectors 14 and 15 may be disposed on different surfaces of the housing 30 to reduce heat transfer between the connectors 14 and 15.

In this embodiment, the pump 13 is positioned below the expander 11. However, the pump 13 may be disposed opposite the expander 11 with the condenser 12 interposed therebetween in accordance with conditions such as the footprint, shape, or dimensions of the air cooling unit 100. In other words, the pump storage 38, the condenser storage 34, and the expander storage 32 may be arranged side by side in this order.

This embodiment discloses a configuration for reducing heat transfer between the expander 11 and the air path leading to the condenser 12. Here, the condenser 12 cools the working fluid that flows through the condenser 12 using air flowing through the air path. Thus, "heat transfer between the expander 11 and the air path leading to the condenser 12" can be also expressed by "heat transfer between the expander 11 and the condenser 12 through the air path". In other words, it can be also said that this embodiment discloses a configuration for reducing heat transfer from the expander 11 to the condenser 12 through the air path and/or heat transfer from the condenser 12 to the expander 11 through the air path. Other embodiments described below also disclose configurations of the same purposes.

Air cooling units according to other embodiments are described below. Unless technically inconsistent, the description on the air cooling unit 100 and the Rankine cycle system 106 made in reference to FIG. 1 to FIG. 4 is applicable to embodiments described below. In addition, the description on the following embodiments is, unless technically inconsistent, not only applicable to the air cooling unit 100 according to the first embodiment but also applicable interchangeably between the embodiments. Instead of the air cooling unit 100 according to the first embodiment, air cooling units according to embodiments described below are usable in the Rankine cycle system 106.

Second Embodiment

Figure 5:
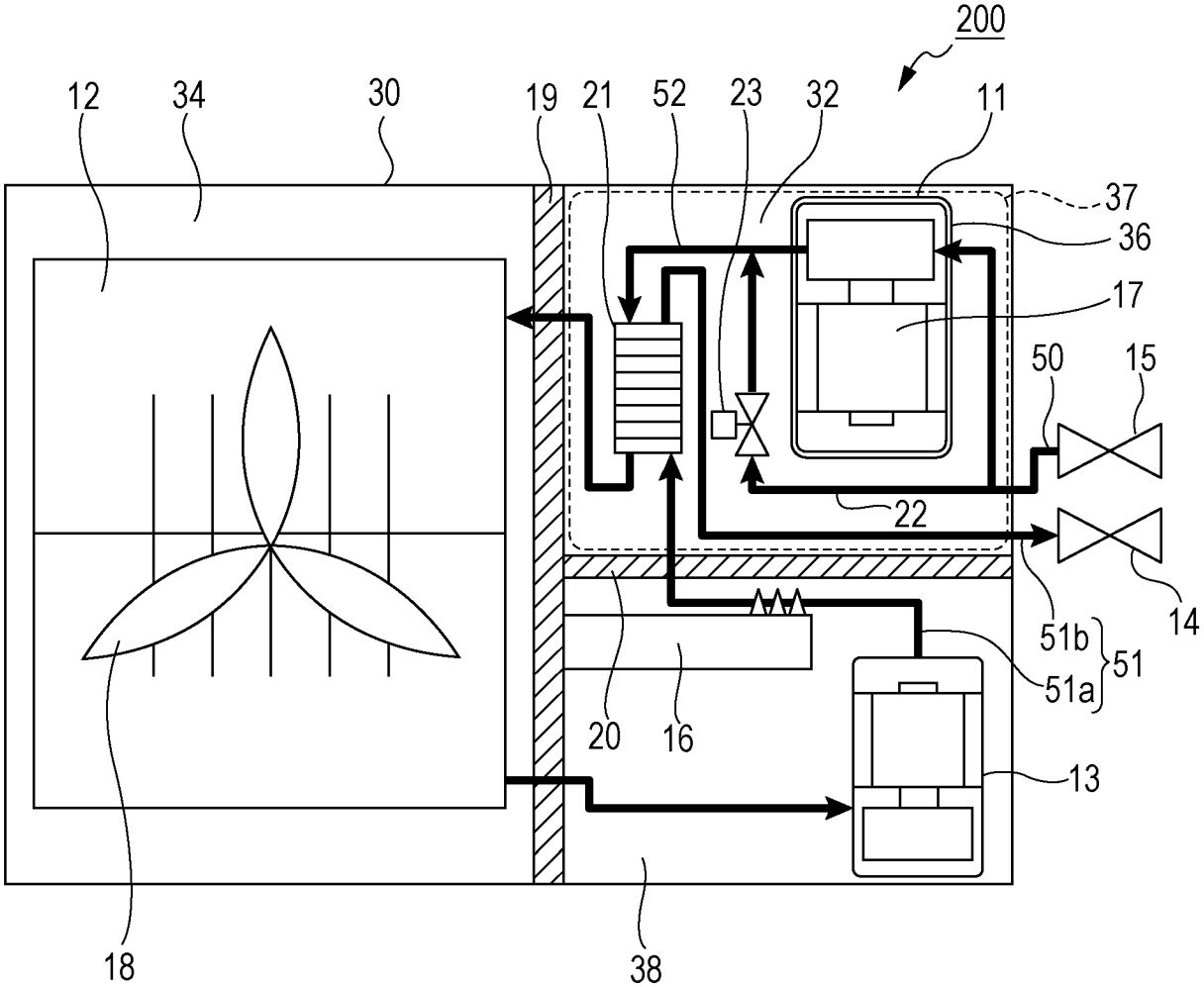
FIG. 5 illustrates a configuration of an air cooling unit according to a second embodiment.

As illustrated in FIG. 5, an air cooling unit 200 according to a second embodiment includes, in addition to the components the same as those in the air cooling unit 100 according to the first embodiment, a reheater 21, a bypass passage 22, and a control valve 23. The reheater 21, the bypass passage 22, and the control valve 23 are housed in the housing 30. The bypass passage 22 is a flow path that bypasses the expander 11 by connecting the flow path 50, which allows the working fluid to flow therethrough to the expander 11, and the flow path 52, which allows the working fluid ejected from the expander 11 to flow therethrough, at a position outside the expander 11. In other words, the bypass passage 22 is a flow path that allows the working fluid to flow into the reheater 21 without passing through the expander 11. In the case where the air cooling unit 200 does not include the reheater 21, the working fluid may be supplied to the condenser 12 through the bypass passage 22. The control valve 23 is disposed on the bypass passage 22 and adjusts the flow rate of the working fluid flowing through the bypass passage 22.

The reheater 21 forms part of the flow path 52 through which the working fluid ejected from the expander 11 flows to the condenser 12. The reheater 21 also forms part of the flow path 51 through which the working fluid ejected from the pump 13 flows to the evaporator 24. In the reheater 21, heat is exchanged between the working fluid that is to be supplied from the expander 11 to the condenser 12 and the working fluid that is to be supplied from the pump 13 to the evaporator 24. The temperature of the working fluid ejected from the expander 11 is, for example, in the range of 100 to 150° C. In the reheater 21, heat energy of the working fluid ejected from the expander 11 can be transferred to the working fluid ejected from the pump 13. Thus, the cooling energy required at the condenser 12 and the heating energy required at the evaporator 24 can be reduced. Consequently, the size of the condenser 12 and the evaporator 24 can be reduced.

The control valve 23 is an opening-degree adjustable valve. The flow rate of the working fluid that bypasses the expander 11 is adjustable by changing the degree of opening of the control valve 23. For example, at the time when the state of the working fluid at the outlet of the evaporator 24 transitionally changes and the cycle is unstable as in at least one of start-up and shutdown of the Rankine cycle system 106, the control valve 23 is controlled so that the control valve 23 is opened. However, the time when the control valve 23 is opened is not limited to the transition of the state of the working fluid. The control valve 23 may be controlled so that the control valve 23 is opened when the state of the working fluid at the outlet of the evaporator 24 is stable.

As illustrated in FIG. 5, also in this embodiment, the air cooling unit 200 includes partitions 19 and 20. The internal space of the housing 30 is partitioned by the partitions 19 and 20 into an expander storage 32, a condenser storage 34, and a pump storage 38. The temperature of the expander storage 32 is the highest among the temperature of the expander storage 32, the temperature of the condenser storage 34, and the temperature of the pump storage 38. The temperature of the expander storage 32 rises up to, for example, 200° C. Since the partitions 19 and 20 reduce the heat transfer from the expander 11, the temperature of the condenser storage 34 and the temperature of the pump storage 38 are several tens of degrees lower than the temperature of the expander storage 32.

In this embodiment, the reheater 21 is disposed in the expander storage 32. When the reheater 21 is disposed in the expander storage 32, the heat of the expander storage 32 can be recovered directly by the reheater 21 or through a pipe connected to the reheater 21. The temperature of the working fluid ejected from the pump 13 is as low as, for example, in the range of 20 to 50° C. The temperature of the working fluid ejected from the expander 11 is, for example, in the range of 100 to 150° C. The temperature of the working fluid ejected from the pump 13 is lower than the temperature of the working fluid ejected from the expander 11. In addition, the temperature of the working fluid that has flowed out of the reheater 21 is lower than the temperature of the working fluid ejected from the expander 11. Thus, the heat energy emitted from the expander 11 can be recovered by the Rankine cycle system 106 using the reheater 21.

The bypass passage 22 and the control valve 23 are also disposed in the expander storage 32. The temperature of the working fluid flowing through the bypass passage 22 on the upstream side of the control valve 23 is generally equal to the temperature of the working fluid at the inlet of the expander 11, for example, 200° C. When the bypass passage 22 and the control valve 23 are disposed in the expander storage 32, heat transfer from a high-temperature working fluid at an upstream portion of the bypass passage 22 to low-temperature members such as the condenser 12 and the pump 13 can be reduced.

As in the case of this embodiment, when the expander 11, the reheater 21, the bypass passage 22, and the control valve 23 are disposed in one enclosed space (expander storage 32), they do not have to be individually covered by heat insulators. The expander storage 32 can be thermally insulated by being surrounded by a heat insulator 37. Thus, the production process of the air cooling unit 200 can be simplified. Naturally, the expander 11, the reheater 21, the bypass passage 22, and the control valve 23 may be individually covered by heat insulators.

The controller 16 is disposed in the pump storage 38. The pump storage 38 is a space having a temperature several tens of degrees lower than the temperature of the expander storage 32 and is thus a useful environment for the controller 16. When the controller 16 is disposed in the pump storage 38, the temperature of the controller 16 can be prevented from rising to an excessive level.

Figure 6:
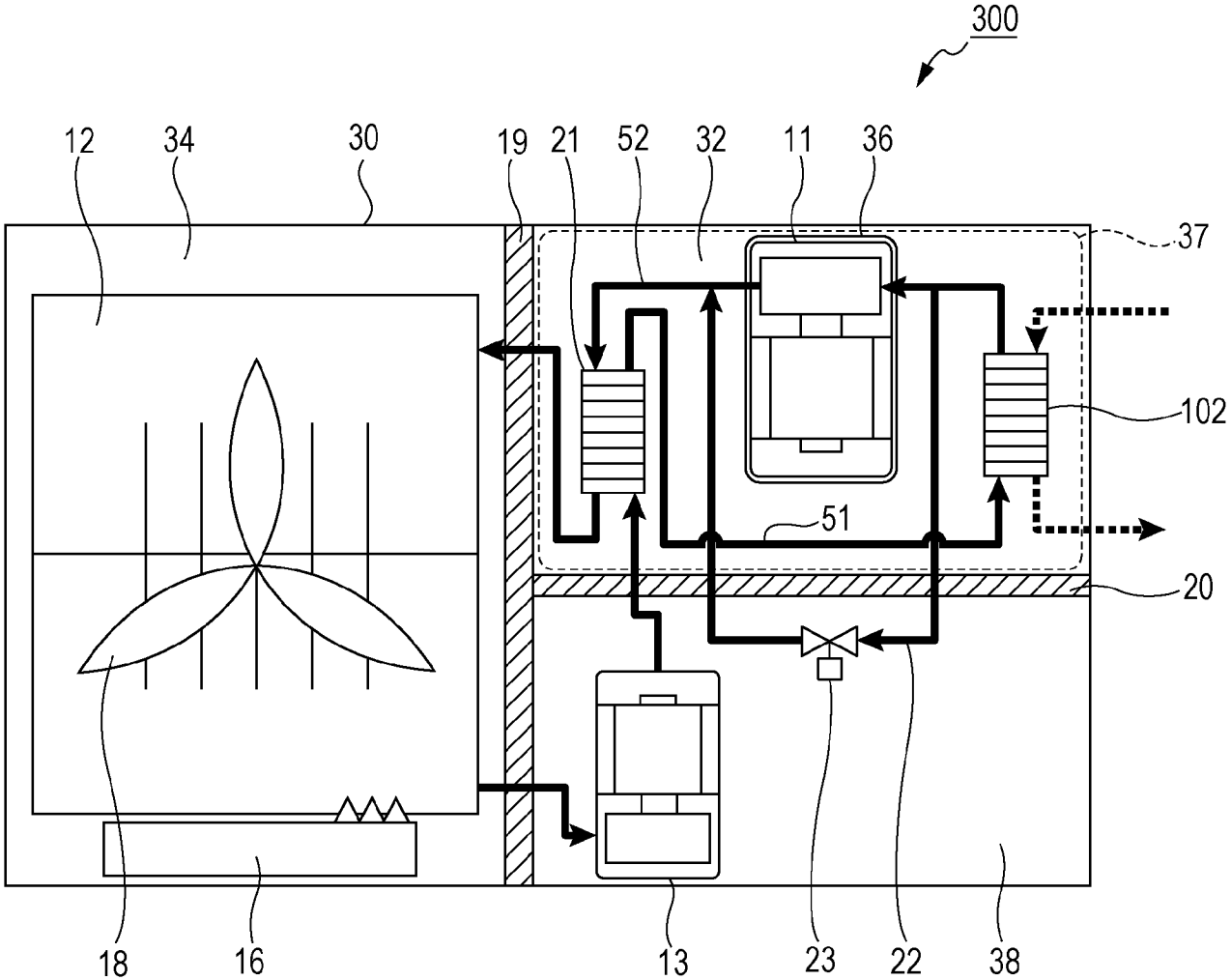
FIG. 6 illustrates a configuration of an air cooling unit according to a third embodiment.

When the controller 16 is disposed in the pump storage 38, the controller 16 can be cooled by the working fluid at the outlet of the pump 13. Typically, the controller 16 includes an electrical controlling circuit. Since the electrical circuit produces heat, the controller 16 needs to be cooled. As described in the first embodiment, the controller 16 can be also cooled by air. On the other hand, as in the case of this embodiment, the controller 16 can be cooled by the working fluid ejected from the pump 13. Although depending on the ambient conditions and the driving conditions of the Rankine cycle system 106, the working fluid at the outlet of the pump 13 is in the liquid phase state and has a temperature in the range of, for example, 20 to 50° C. Such a working fluid is effective in cooling the controller 16. Specifically, the controller 16 can be cooled due to part (flow path 51*a*) of the flow path 51 (pipe) connected to the outlet of the pump 13 being in contact with the controller 16 (a heating portion of the controller 16). Thus, the temperature of the controller 16 can be prevented from rising to an excessive level. In FIG. 6, the flow path 51 passes through the reheater 21. However, even in the case where the air cooling unit 200 does not include the reheater 21, the similar effects can be obtained when the flow path 51 connected to the outlet of the pump 13 is in contact with the controller 16.

In this embodiment, the flow path 50 (first flow path) for connecting the expander 11 to the evaporator 24 of the Rankine cycle system 106 extends to the outside of the housing 30 through the expander storage 32. The connector 15 for connecting the evaporator 24 to the flow path 50 is disposed outside the housing 30. In addition, part (flow path 51*b*) of the flow path 51 (second flow path) for connecting the pump 13 to the evaporator 24 of the Rankine cycle system 106 extends to the outside of the housing 30 through the expander storage 32. The connector 14 for connecting the evaporator 24 to the flow path 51 is disposed outside the housing 30. The connectors 14 and 15 are attached to, for example, portions of the expander storage 32 of the housing 30. With this configuration, the flow paths 50 and 51*b* (pipes) through which a relatively high-temperature working fluid flows can be stored in the expander storage 32. Consequently, heat transfer to the air path leading to the condenser 12 and the pump 13 can be reduced.

Third Embodiment

As illustrated in FIG. 6, an air cooling unit 300 according to a third embodiment also includes an evaporator 102. The evaporator 102 is stored in the housing 30. The evaporator 102 heats and evaporates the working fluid that has flowed out of the reheater 21 with a heat medium (such as water or oil) supplied from the outside of the air cooling unit 300. Examples usable as the evaporator 102 include a publicly-known heat exchanger such as a plate heat exchanger. The use of the air cooling unit 300 dispenses with an evaporator 24 outside the air cooling unit.

The air cooling unit 300 according to the third embodiment also includes partitions 19 and 20. The internal space of the housing 30 is partitioned by the partitions 19 and 20 into an expander storage 32, a condenser storage 34, and a pump storage 38. The evaporator 102 is disposed in the expander storage 32. In the air cooling unit 300, the temperature is highest at the evaporator 102. Disposing the evaporator 102 in the expander storage 32 enables reduction of heat transfer between the evaporator 102 and the air path leading to the condenser 12 and reduction of heat transfer between the evaporator 102 and the pump 13.

In this embodiment, the control valve 23 is disposed in the pump storage 38. Examples usable as the control valve 23 include an electric control valve including an actuator that electrically drives the valve. Actuators may deteriorate due to heat. Thus, when the control valve 23 is disposed in the low-temperature pump storage 38, the control valve 23 can be prevented from being damaged due to heat. Consequently, the control valve 23 has higher prolonged reliability. For the same reason, the control valve 23 may be disposed in the condenser storage 34.

As illustrated in FIGS. 5 and 6, in the second embodiment and the third embodiment, the bypass passage 22 and the control valve 23 are included in the air cooling units 200 and 300, each including the reheater 21. However, the bypass passage 22 and the control valve 23 may be included in an air cooling unit that does not include the reheater 21 (for example, the air cooling unit 100 according to the first embodiment).

Fourth Embodiment

Figure 7:
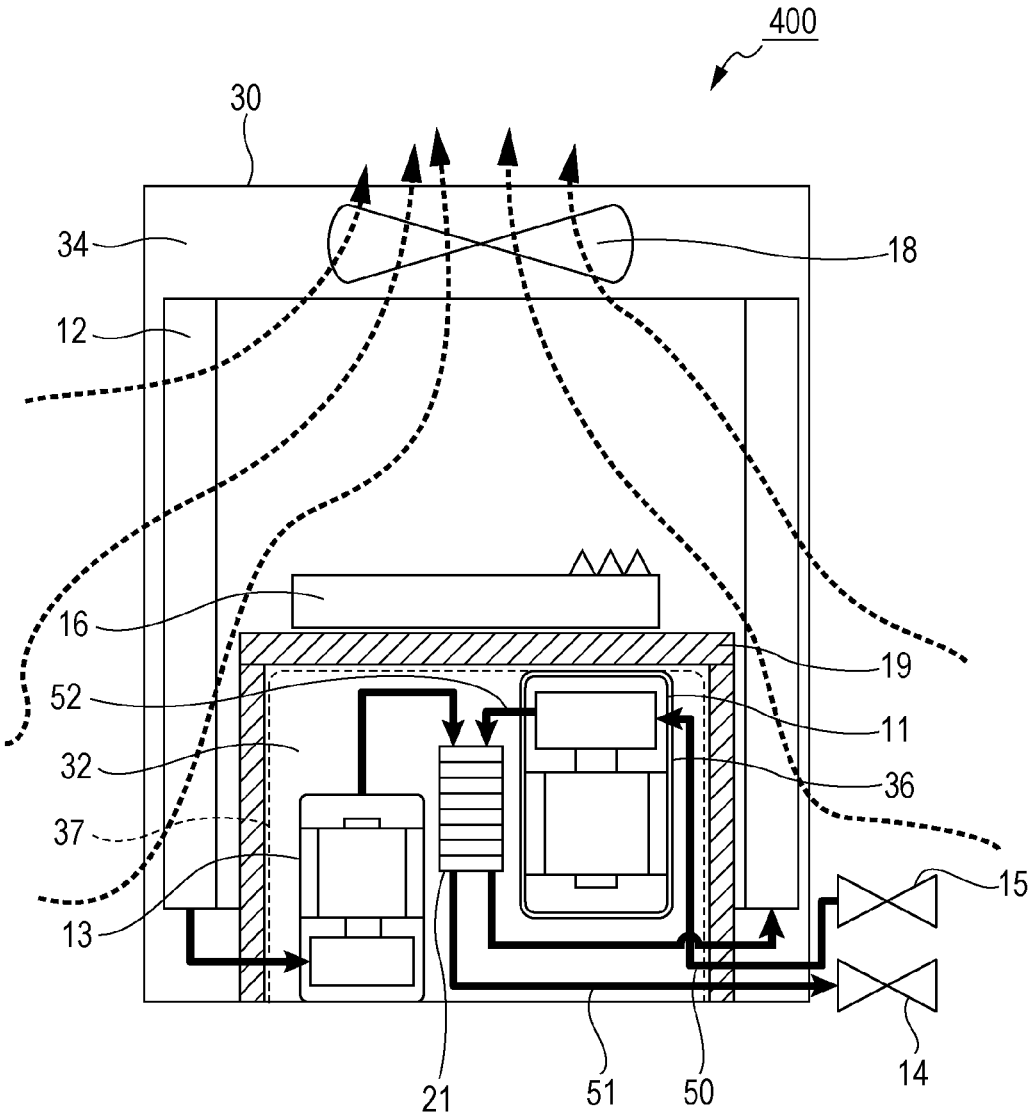
FIG. 7 illustrates a configuration of an air cooling unit according to a fourth embodiment.

As illustrated in FIG. 7, in an air cooling unit 400 according to a fourth embodiment, the fan 18 is disposed at an upper portion of the housing 30. When viewed from above, the entirety of the condenser 12 has a U shape. The U-shaped condenser 12 is advantageous in terms of an increase in heat-transfer area relative to the footprint. The condenser 12 is arranged along multiple wall surfaces of the housing 30 (specifically, three side surfaces). An air path leading to the condenser 12 is formed so that air sucked into the internal space of the housing 30 through the multiple side surfaces (three side surfaces) of the housing 30 is blown upward via the condenser 12. Since the condenser 12 has a U shape, the expander storage 32 is surrounded on three sides by the condenser 12. Since the partition 19 is disposed between the expander 11 and the condenser 12, the partition 19 reduces heat transfer between the expander 11 and the condenser 12.

In this embodiment, the air path is formed so that the air sucked into the internal space of the housing 30 through the side surfaces of the housing 30 is blown upward via the condenser 12. In this case, natural convection that occurs due to air heated by the condenser 12 is also usable for ejecting air from the internal space of the housing 30. Instead, the air path leading to the condenser 12 may be formed so that the air sucked into the internal space of the housing 30 from the top of the housing 30 is blown sideways via the condenser 12. Alternatively, the condenser 12 may have a hollow rectangular shape when the entirety of the condenser 12 is viewed from above. Specifically, the condenser 12 may be arranged along the four side surfaces of the housing 30. Still alternatively, the air path leading to the condenser 12 may be formed so that air is sucked into the internal space of the housing 30 through not only the side surfaces but also the bottom surface of the housing 30 and blown out of the housing 30.

In this embodiment, the expander 11, the reheater 21, and the pump 13 are disposed in the expander storage 32. The reheater 21 is positioned between the expander 11 and the pump 13. The reheater 21 has a temperature halfway between the temperature of the expander 11 and the temperature of the pump 13. The above-described positional relationship thus enables reduction of direct heat transfer between the high-temperature expander 11 and the low-temperature pump 13.

Fifth Embodiment

Figure 8:
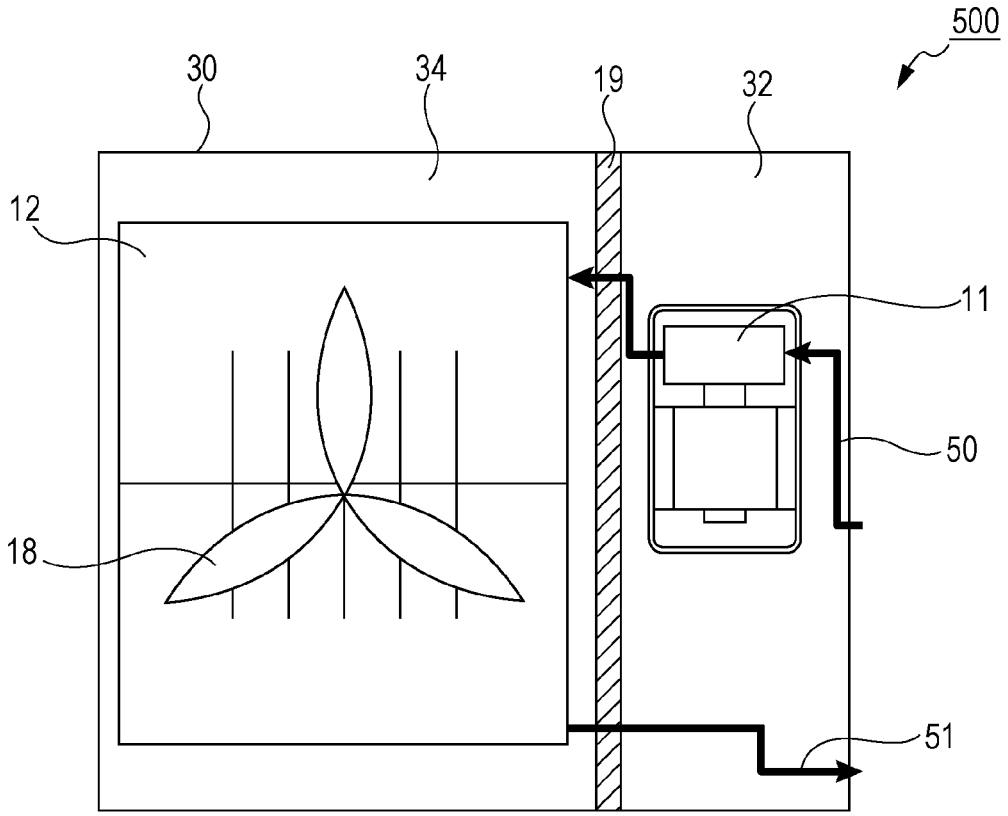
FIG. 8 illustrates a configuration of an air cooling unit according to a fifth embodiment.
Figure 9:
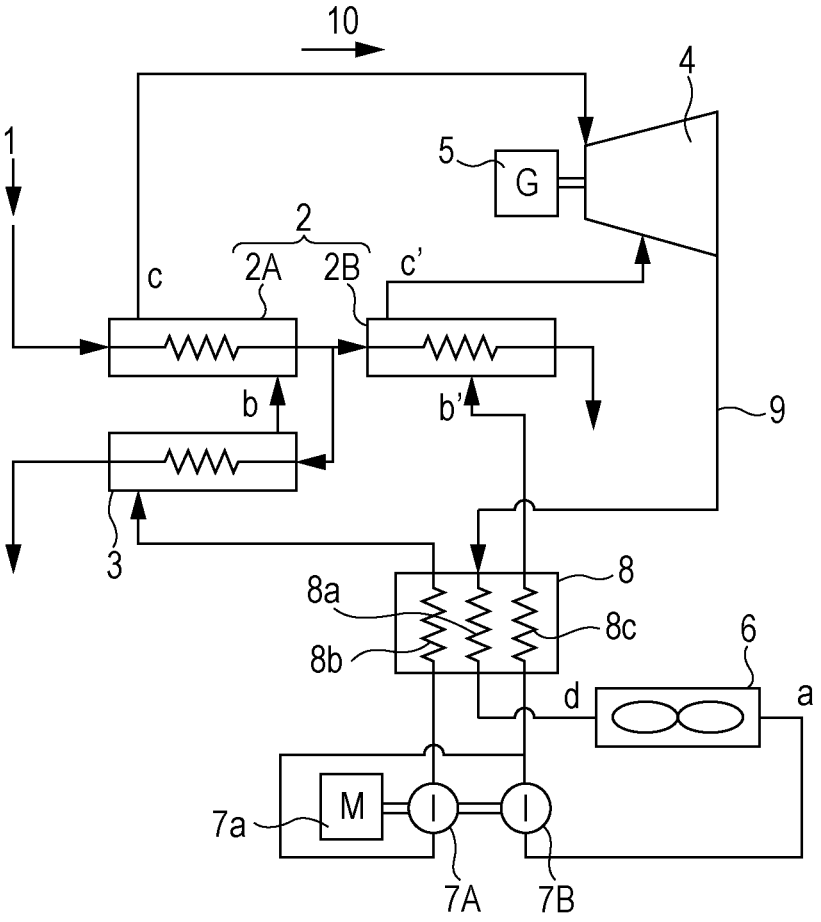
FIG. 9 illustrates a configuration of a binary cycle power generating system, which is an existing waste-heat recovery generator.

As illustrated in FIG. 8, an air cooling unit 500 according to a fifth embodiment includes an expander 11, a condenser 12, a fan 18, a partition 19, and a housing 30. The expander 11, the condenser 12, and the partition 19 are housed in the housing 30.

As in the case of the air cooling unit 100 illustrated in FIG. 3, the air cooling unit 500 is used to constitute the Rankine cycle system 106 including the evaporator 24.

The housing 30 includes an expander storage 32 for storing the expander 11 and a condenser storage 34 for storing the condenser 12. The expander storage 32 and the condenser storage 34 are partitioned by the partition 19.

The above-described configuration is the same as that according to the first embodiment and is thus not described in detail.

In this embodiment, the partition 19 is used as an example of the heat-transfer reducer. Instead of the partition 19 or in addition to the partition 19, a second heat insulator (not illustrated) that surrounds the expander 11 may be provided as in the case of the heat insulator 36 illustrated in FIG. 1 and other drawings.

Instead of the second heat insulator or in addition to the second heat insulator, a first heat insulator (not illustrated) that surrounds the expander storage 32 may be provided as in the case of the heat insulator 37 illustrated in FIG. 1 and other drawings.

Although not illustrated in FIG. 8, a pump that receives the working fluid ejected from the condenser 12 and ejects the working fluid to circulate the working fluid in the Rankin cycle system may be provided inside the housing 30 or outside the housing 30 (that is, outside the air cooling unit 500).

In the case where the evaporator 24 is disposed outside the housing 30 as illustrated in FIG. 3, a first connector and a second connector that connect the air cooling unit 500 and the evaporator 24 to each other are provided. Here, the first connector connects the first flow path 50 to a pipe connected to the outlet of the evaporator 24 like the connector 15 illustrated in FIG. 1 and other drawings. In addition, the second connector connects the second flow path 51 to a pipe connected to the inlet of the evaporator 24 like the connector 14 illustrated in FIG. 1 and other drawings.

Here, the first connector and the second connector may be disposed outside the housing 30 as in the case of the first embodiment. Alternatively, the first connector and the second connector may be disposed opposite the space in which the condenser 12 is disposed with a space in which the expander 11 or the pump is disposed interposed therebetween.

The air cooling unit 500 may include an evaporator in the housing 30. In this case, as illustrated in, for example, FIG. 6, an evaporator 102 may be disposed inside the expander storage 32.

The air cooling unit 500 according to this embodiment may also include, as in the case of the second embodiment, a bypass passage, through which the working fluid flows while bypassing the expander 11, and a control valve, which is disposed on the bypass passage and which adjusts the flow rate of the working fluid flowing through the bypass passage. The control valve may be disposed in the expander storage 32.

The air cooling unit 500 according to this embodiment may further include, as in the case of the third embodiment, a bypass passage, through which the working fluid flows while bypassing the expander 11, and a control valve, which is disposed on the bypass passage and which adjusts the flow rate of the working fluid flowing through the bypass passage. The control valve may be disposed in the condenser storage 34.

The technology disclosed herein is effective for a waste-heat recovery generator that recovers waste-heat energy ejected from facilities such as factories or incinerators for use in power generation. In addition to the recovery of waste-heat energy, the technology disclosed herein is widely applicable to power generation systems using a heat source such as a boiler.

What is claimed is:

1. An air cooling unit for use in a Rankine cycle system, comprising:

a housing;

a partition in the housing to restrict air flow between an expander storage and a condenser storage, the partition isolating air flow in the condenser storage from flowing into the expander storage;

an expander that is disposed in the expander storage and that expands a working fluid so as to recover energy therefrom;

a condenser that is disposed in the condenser storage; and a fan that is disposed in the condenser storage and that generates cooling air flowing through the condenser and through the condenser storage;

wherein the expander storage isolates the cooling air flowing through the condenser from cooling the expander.

2. The air cooling unit according to claim 1, further comprising a pump that receives the working fluid ejected from the condenser and ejects the working fluid to circulate the working fluid in the Rankin cycle system.

3. The air cooling unit according to claim 2, wherein the expander is positioned above the pump.

4. The air cooling unit according to claim 1, further comprising:

a pump that receives the working fluid ejected from the condenser and ejects the working fluid to circulate the working fluid in the Rankin cycle system, wherein internal space of the housing is partitioned into a pump storage in which the pump is disposed.

5. The air cooling unit according to claim 1, further comprising:

a pump that receives the working fluid ejected from the condenser and ejects the working fluid to circulate the working fluid in the Rankin cycle system and is provided in the housing, wherein a first flow path for connecting the expander to an evaporator disposed outside the air cooling unit extends to an outside of the housing through the expander storage, wherein a second flow path for connecting the pump to the evaporator disposed outside the air cooling unit extends to the outside of the housing through the expander storage, and wherein a first connector for connecting a pipe connected to an outlet of the evaporator to the first flow path and a second connector for connecting a pipe connected to an inlet of the evaporator to the second flow path are disposed outside the housing.

6. The air cooling unit according to claim 1, wherein the fan is positioned upwind from the condenser.

7. The air cooling unit according to claim 1, further comprising a controller that is positioned upwind from the condenser and that controls the air cooling unit or the Rankine cycle system.

8. The air cooling unit according to claim 1, further comprising an evaporator that evaporates the working fluid.

9. The air cooling unit according to claim 1, further comprising at least one selected from the group consisting of:

a first insulator surrounding the expander storage to reduce heat transfer from the expander storage; and a heat insulator surrounding the expander to reduce heat transfer from the expander.

* * * * *